US005801629A

United States Patent [19]

Lehmann et al.

[11] Patent Number: 5,801,629

[45] Date of Patent: *Sep. 1, 1998

[54] MOTION SENSITIVE REMINDER

[76] Inventors: Roger W. Lehmann, 808 Ashley Ave., Brielle, N.J. 08730; Michael I. Satten, 26 Cow La., Kings Point, N.Y. 11024

[ * ] Notice: The term of this patent shall not extend beyond the expiration date of Pat. No. 5,721,532.

[21] Appl. No.: 855,562

[22] Filed: May 13, 1997

Related U.S. Application Data

[63] Continuation-in-part of Ser. No. 801,447, Feb. 18, 1997, which is a continuation-in-part of Ser. No. 764,823, Dec. 12, 1996, Pat. No. 5,721,532.

[51] Int. Cl.[6] ..... G08B 13/14

[52] U.S. Cl. ..... 340/571; 340/573; 340/686; 340/693; 340/457; 340/432

[58] Field of Search ..... 340/573, 571, 340/686, 691, 693, 457, 432

[56] References Cited

U.S. PATENT DOCUMENTS

| | | | |
|---|---|---|---|
| 3,436,726 | 4/1969 | Dentz | 340/457 |
| 3,870,818 | 3/1975 | Barton et al. | 704/258 |
| 4,016,538 | 4/1977 | Miller | 340/457 |
| 4,051,397 | 9/1977 | Taylor | 310/329 |
| 4,229,663 | 10/1980 | Sibley | 307/9.1 |
| 4,412,205 | 10/1983 | Von Kemenczky | 340/331 |
| 4,764,111 | 8/1988 | Knierim | 340/573 |
| 4,972,177 | 11/1990 | Nolan | 340/573 |
| 4,980,667 | 12/1990 | Ames | 340/427 |
| 5,294,914 | 3/1994 | Dallas | 340/432 |
| 5,315,289 | 5/1994 | Fuller et al. | 340/532 |
| 5,316,515 | 5/1994 | Hyman et al. | 446/28 |

*Primary Examiner*—Jeffery A. Hofsass
*Assistant Examiner*—Benjamin C. Lee
*Attorney, Agent, or Firm*—Caesar, Rivise, Bernstein, Cohen & Pokotilow, Ltd.

[57] ABSTRACT

A compact motion sensitive reminder device that is readily attachable to almost any movable item that emits a visual indication when the item is initially moved from a stationary condition and then remains off during the item's use, and emits the visual indication again only after a certain amount of time that the movable item has remained stationary. Another embodiment of the compact motion sensitive reminder device is integrally formed with an item that is worn by the user, e.g., a roller blade, helmet, etc., and which provides a tactile indication to the person when the item is initially moved from a stationary condition and then remains off during the item's use, and emits the tactile indication again only after a certain amount of time that the movable item has remained stationary.

61 Claims, 5 Drawing Sheets

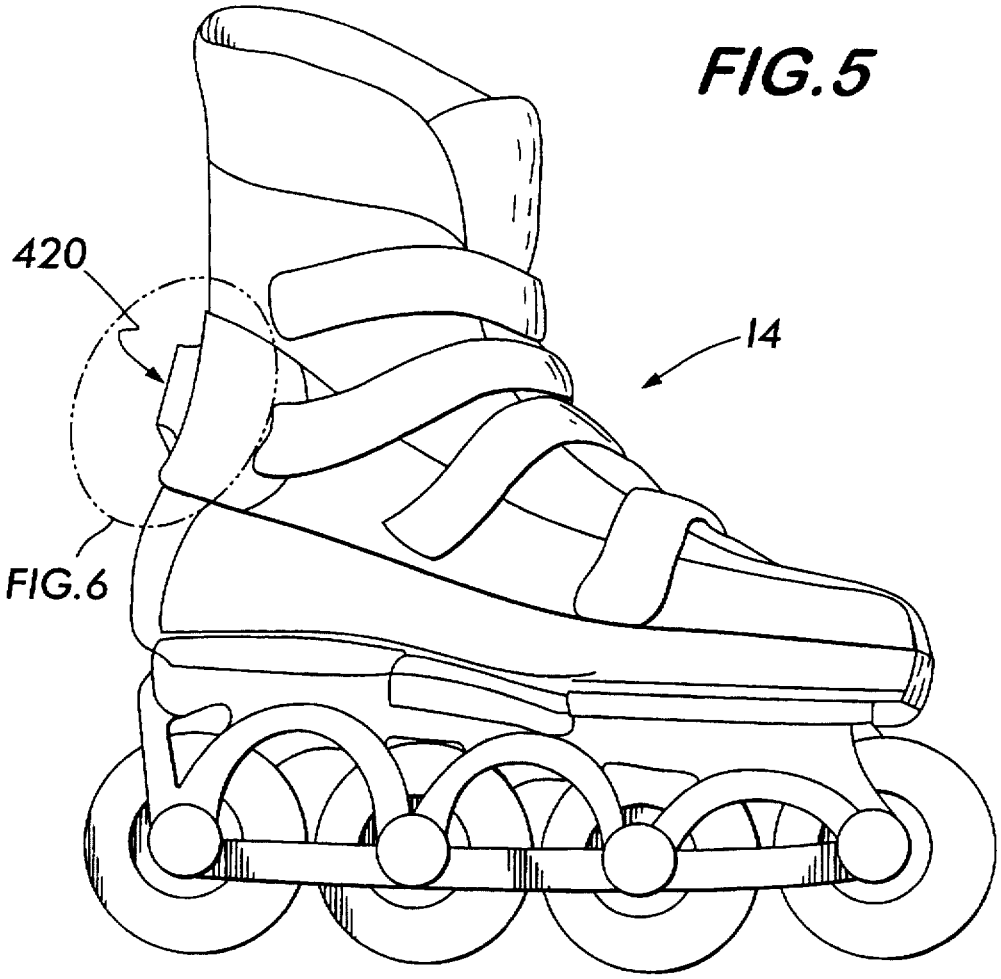
FIG.5
420
14
FIG.6
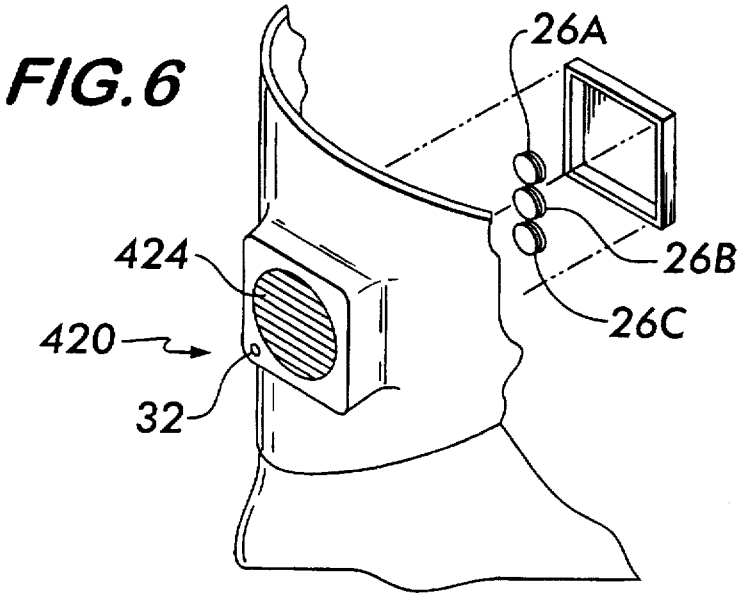
FIG.6
26A
26B
26C
424
420
32

MOTION SENSITIVE REMINDER

RELATED APPLICATIONS

This application is a Continuation-in-Part of Co-Pending application Ser. No. 08/801,447 filed Feb. 18, 1997, entitled MOTION SENSITIVE REMINDER which is a Continuation-in-Part of application Ser. No. 08/764,823 filed Dec. 12, 1996, now U.S. Pat. No. 5,721,532, entitled MOTION SENSITIVE REMINDER, and both of whose disclosures are incorporated by reference herein.

FIELD OF THE INVENTION

The invention relates generally to automatic advisory devices and more specifically to automatic visual and tactile warning devices that are attachable to, or integrally formed with, items that can be moved such as apparel, sports equipment, luggage, or any movable components on a stationary device, etc., for reminding the user to take appropriate action upon initial movement of the item.

BACKGROUND OF THE INVENTION

The following U.S. Patents disclose motion detection alerting devices, such as those used on vehicles, bicycles and children's toys.

U.S. Pat. No. 4,980,667 (Ames) discloses a bicycle alarm device for audibly warning the bicycle owner that his/her bicycle is being moved impermissibly.

U.S. Pat. No. 5,294,914 (Dallas) discloses a bicycle helmet warning system to alert the seated rider that the helmet stowed in a helmet holder of the bicycle is not being worn.

U.S. Pat. No. 4,016,538 (Miller) discloses a safety device for a motorcycle which includes a device that actuates the horn of a motorcycle if the side stand is down, the ignition is on, and the motorcycle is in the driving position.

U.S. Pat. No. 5,316,515 (Hyman et al.) discloses a child's toy that is worn by the child and includes, among other things, a motion switch for detecting movements of the toy and for generating sounds responsive to the movements.

U.S. Pat. No. 4,051,397 (Taylor) discloses a two-sensitivity level kinetic sensor that activates an alarm circuit whenever the surface, upon which the sensor is disposed, is moved. U.S. Pat. No. 4,229,663 (Sibley) discloses a device for sensing vehicular mechanical motion.

U.S. Pat. No. 4,412,205 (Von Kemenczky) discloses a switch device for use on an illuminated article worn by a user that illuminates when certain motions are made by the wearer.

U.S. Pat. No. 5,315,289 (Fuller et al.) discloses an interactive protective system that includes a protective garment worn by the operator and includes sensors which detect respective conditions for alerting the operator about nearby dangers.

U.S. Pat. No. . 3,870,818 (Barton et al.) and U.S. Pat. No. 4,933,852 (Lemelson) disclose apparatus for indicating operational characteristics of a machine, such as a motor vehicle, that utilizes among other things synthetic speech to advise the operator of appropriate action to be taken.

U.S. Pat. No. . 3,436,726 (Dentz) discloses a hood actuated warning device for motor vehicles that warns the operator in the event that the hood of the vehicle is not fully closed at such times when the vehicle is being operated.

However, there remains a need for a compact device that is readily attachable to almost any movable item, or that is integrally-formed with any movable item, that provides a visual reminder, or a tactile reminder, to a person to do something or to take appropriate action when that person initially moves the item and whereby the visual reminder or tactile reminder then remains inactive during the item's use, and emits either the visual reminder or tactile reminder, respectively, again only after a certain amount of time that the item remains stationary.

OBJECTS OF THE INVENTION

Accordingly, it is the general object of this invention to provide an apparatus which improves upon and overcomes the disadvantages of the prior art.

It is another object of this invention to provide a motion sensitive reminder device that is small in size.

It is still another object of this invention to provide a motion sensitive reminder device that is attachable to any movable item.

It is still yet another object of this invention to provide a motion sensitive reminder device that minimizes power consumption.

It is even a further object of this invention to provide a motion sensitive reminder device that provides a visible indication without becoming a nuisance.

It is yet another object of this invention to provide a motion sensitive reminder that provides a tactile indication without becoming a nuisance.

It is still yet a further object of this invention to provide a motion sensitive reminder device that automatically resets itself under predetermined conditions.

It is still yet another object of this invention to provide a motion sensitive reminder device that indicates to the user when power is low.

SUMMARY OF THE INVENTION

These and other objects of the instant invention are achieved by providing a motion sensitive reminder apparatus that is adaptable for coupling to any item that is movable. The motion sensitive reminder comprises a housing and means for releasably coupling the housing to the movable item. The housing comprises a visual indicator for emitting a visible indication (e.g., a flashing light emitting diode), a motion sensor for detecting movement of the movable item, and electronic control means. The electronic control means is electrically coupled to the visual indicator and to the motion sensor and controls the visual indicator emission. The electronic control means activates the visual indicator to emit the visible indication for a predetermined period of time whenever the movable item is initially moved and thereafter deactivates the visual indicator during further motion of the movable item. The electronic control means resets the visual indicator to prepare to emit the visible indication again whenever the movable item has remained stationary for a certain amount of time.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 5 is depicts the present invention using a vibrating indicator as an integral portion of a roller blade;

FIG. 6 is an enlarged view of the present invention of FIG. 5; and

DETAILED DESCRIPTION OF THE PREFERRED EMBODIMENT

Figure 1:
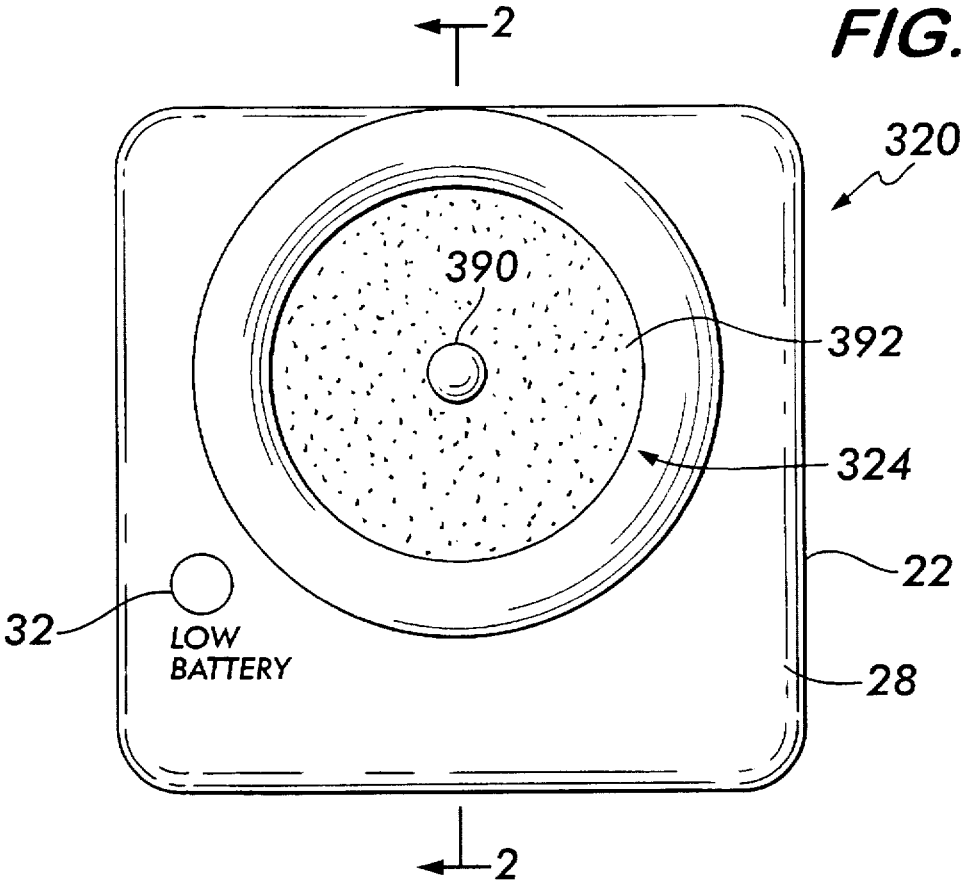
FIG. 1 is an enlarged front view of the present invention using a visible indicator.
Figure 2:
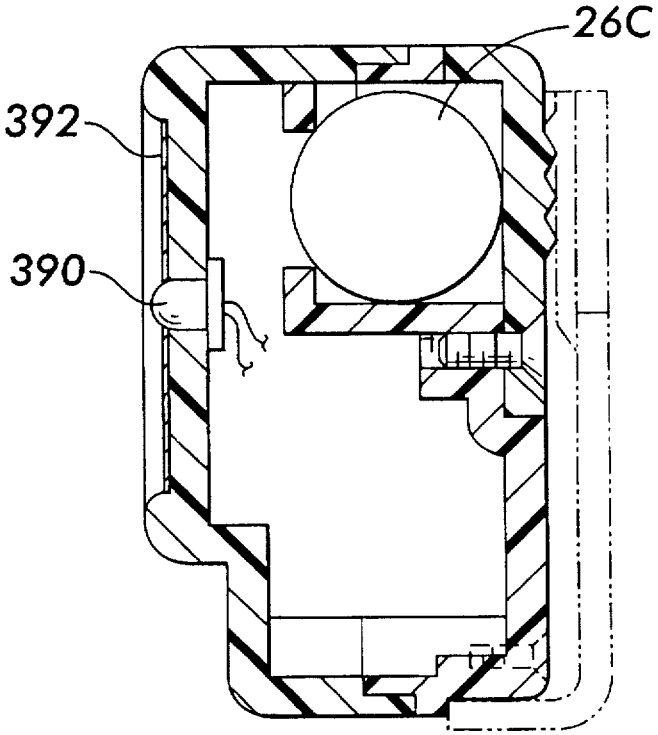
FIG. 2 is an enlarged sectional view taken along line 2—2 of FIG. 1.
Figure 3:
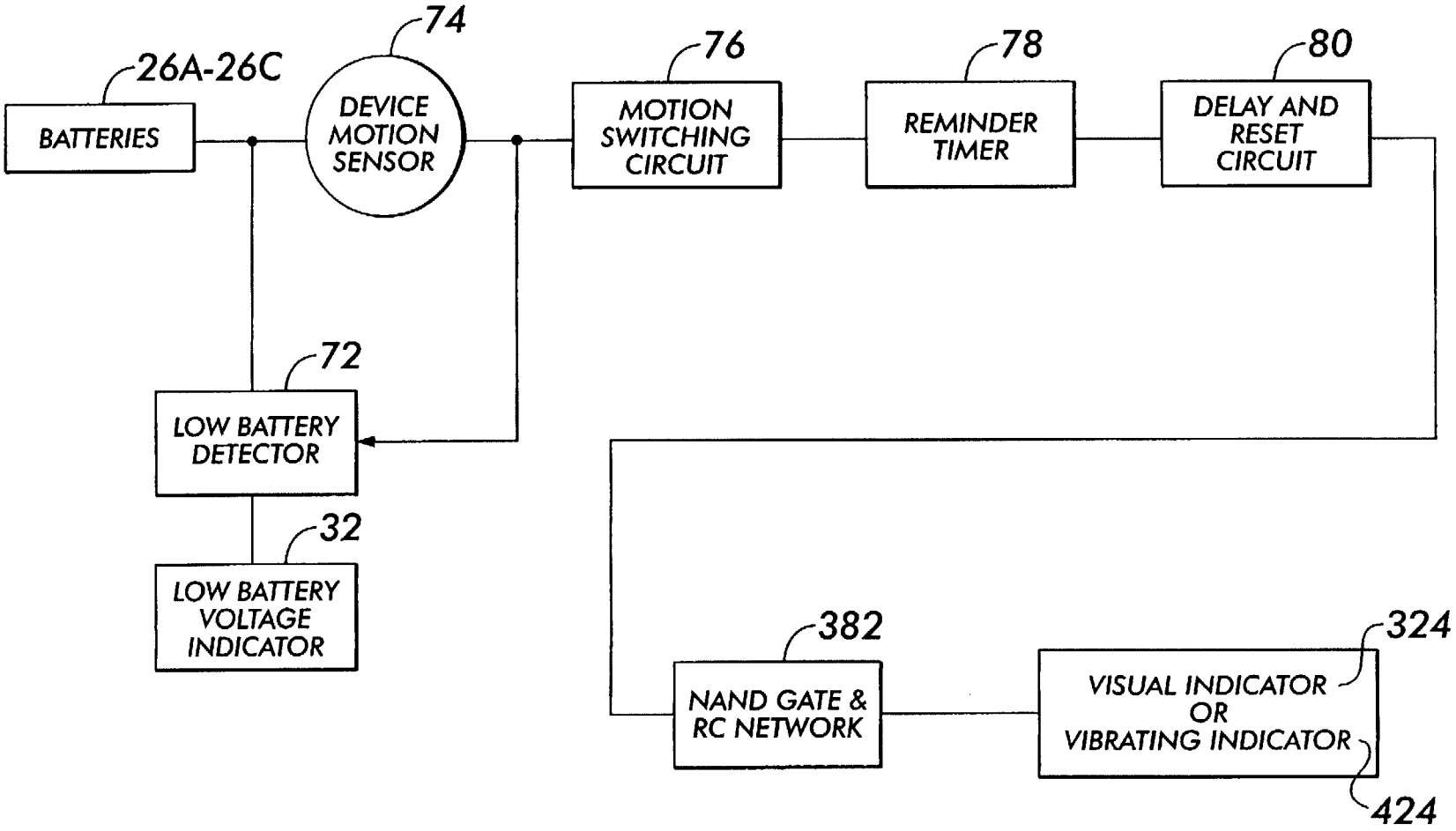
FIG. 3 is a block diagram of the electronics of the present invention.
Figure 4:
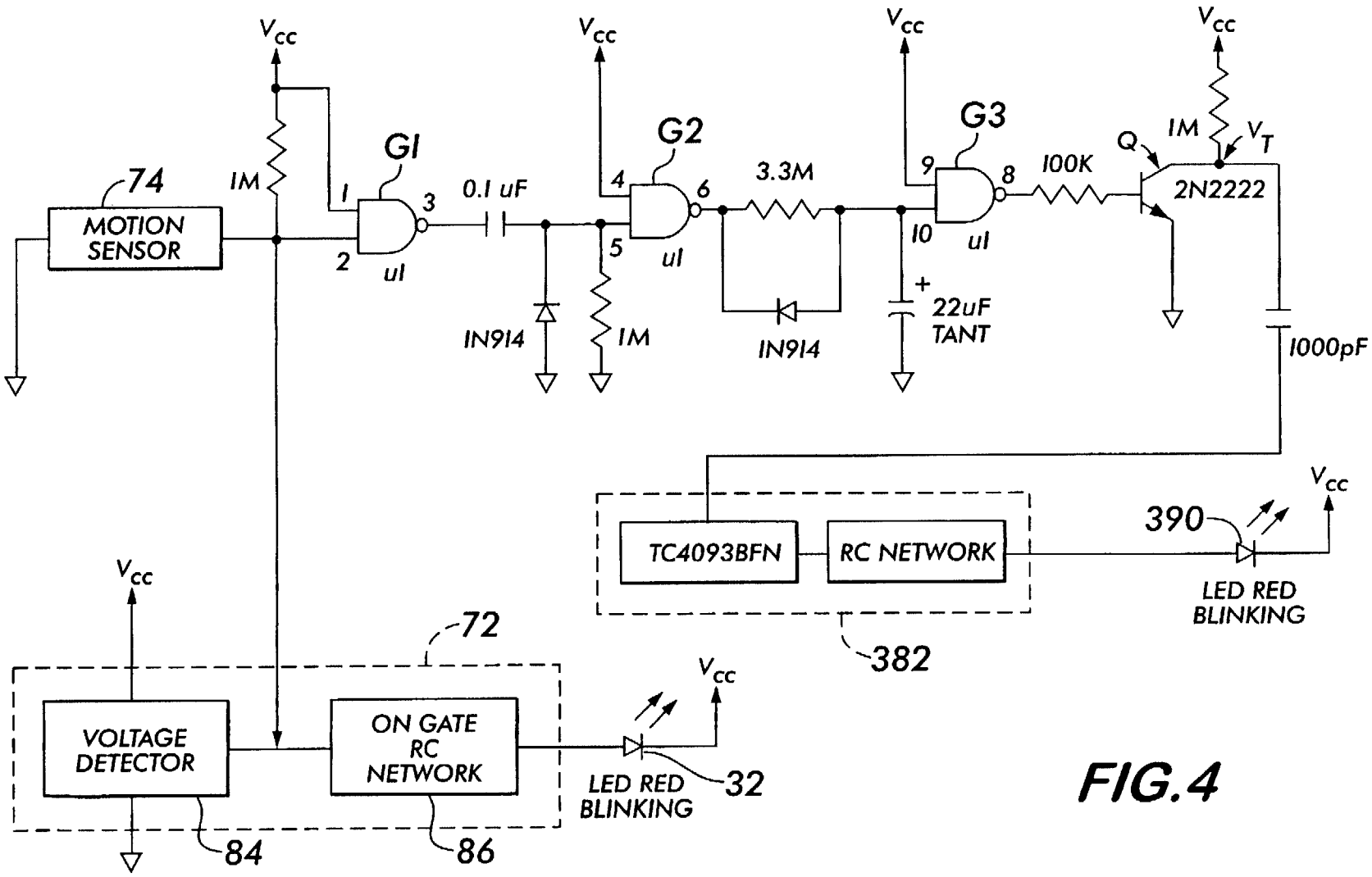
FIG. 4 is a circuit schematic of the electronics of the present invention using a visible indicator.

Referring now in detail to the various figures of the drawing wherein like reference characters refer to like parts, there is shown at 320 in FIG. 1, a motion sensitive reminder (hereinafter "MSR"). The MSR 320 is a compact unit that is similar to the MSR 20 disclosed in application Ser. No. 08/764,823, whose discosure is incorporated by reference herein, except that instead of providing a speaker, the MSR 320 provides a visual indicator 324 (e.g., an LED) and supporting electronics (FIGS. 3–4). In all other aspects, the MSR 320 is identical to the MSR 20.

In particular, the electronics of the MSR 320 are identical to the electronics of the MSR 20 (FIG. 4 of application Ser. No. 08/764,823) except that the audio circuit 82 has been replaced by a NAND gate and RC network 382 (hereinafter "logic and timing circuit 382") and an LED 390. The visual indicator 324 comprises the LED 390 in combination with a reflective mylar 392 that helps disperse the light emitted from the LED 390. The logic and timing circuit 382 provide the appropriate LED driving circuit for causing the LED 390 to flash for the same period of time that the speaker 24 would emit an audible signal as disclosed in application Ser. No. 08/764,823, i.e., turning on transistor Q (FIG. 4) causes the voltage $V_T$ to drop to ground, thus triggering the logic and timing circuit 382 to cause the LED 390 to flash. Once triggered, the timer within the logic and timing circuit 382 causes the LED 390 to flash for approximately 6 seconds.

As shown more clearly in FIG. 4, the logic and timing circuit 382 comprises a TC4093BFN, and associated resistors and capacitors, for providing the proper timing circuit. As long as the MSR 320 is in motion, the 22 μF capacitor continues to be discharged and the transistor Q remains on with $V_T$ at ground. However, since the logic and timing circuit 382 is only triggered by the drop of $V_T$ from high to ground, the logic and timing circuit 382 remains off. Once the MSR 320 is stationary, the input G2 goes to a steady logic "0", the output of G2 goes to a steady logic "1" and the 22 μF capacitor begins to slowly charge up for the 72.6 seconds. After the 22 μF capacitor is charged, the output G3 goes to a steady logic "0" and the logic and timing circuit 382 is reset awaiting another initial motion detection.

Figure 7:
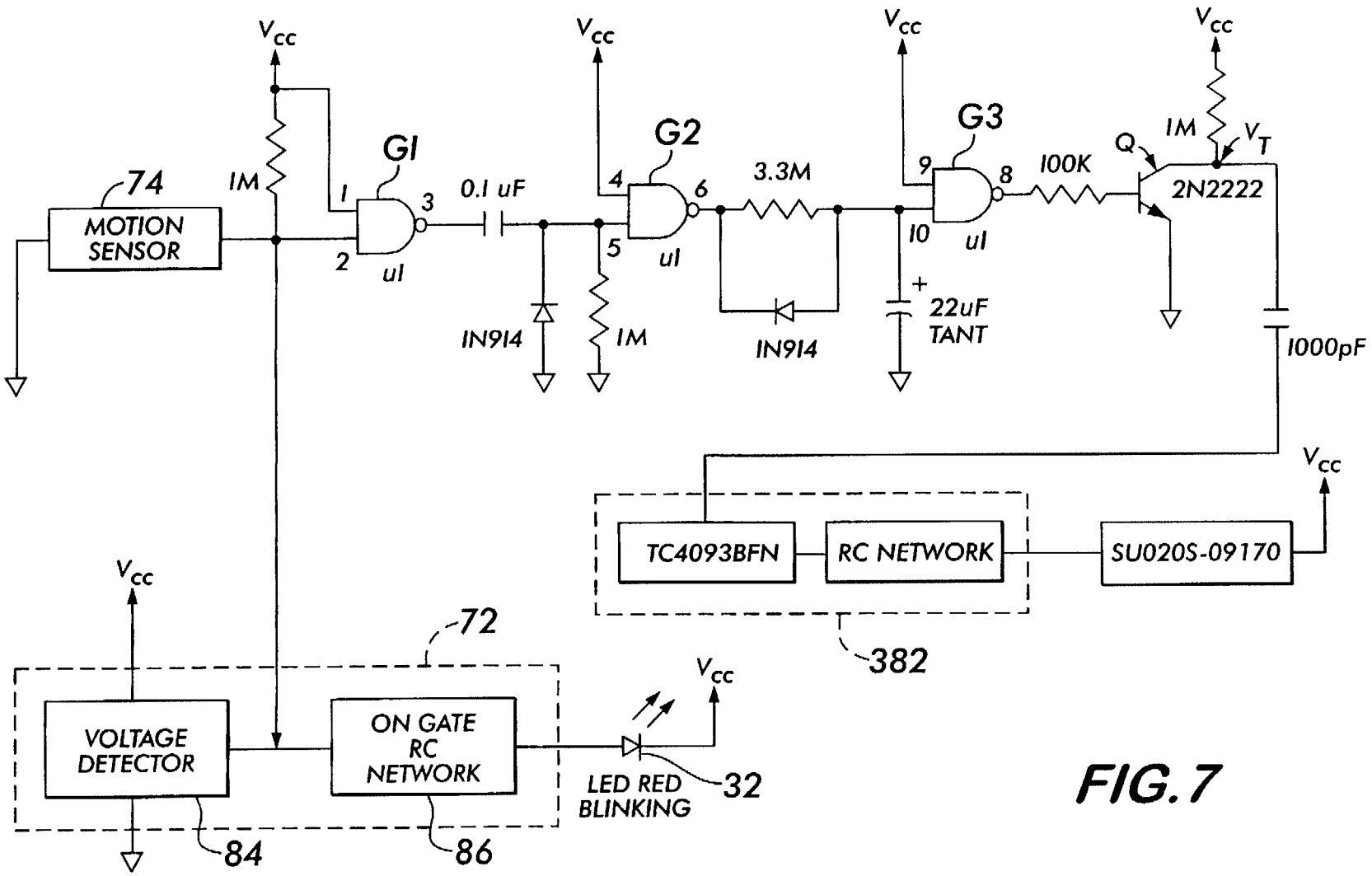
FIG. 7 is a circuit schematic of the electronics of the present invention using a vibrating indicator.

Another embodiment, a vibrating indicator MSR 420, is shown in FIGS. 5–7. The MSR 420 is a compact integral unit that is similar to the MSR 220 disclosed in application Ser. No. 08/801,447, which is incorporated by reference herein, except that instead of providing a speaker, the MSR 420 provides a vibrating indication (e.g., an SU 020S-09170 motor/weight combination which forms a vibrator device) to the person wearing the item, e.g., a roller blade 14 as shown in FIGS. 5–6. The supporting electronics are shown in FIGS. 3 and 7. The vibrating indicator 420 is integrally formed with the item so that the vibrations can be perceived in a tactile manner by the person wearing the item. In all other aspects, the MSR 420 is identical to the MSR 220. Electrical operation of the MSR 420 is identical to the above operation for the MSR 320 except that instead of a flashing light being activated upon motion of the movable item, a vibrating sensation to the person wearing the item is activated for the predetermined period (e.g., approximately 6 seconds).

It is thus within the broadest scope of the present invention that the MSR 420 can also form an integral portion of almost any movable item that can be worn by the user (e.g., helmet, gloves, belt, etc.) by being part of the manufacturing of the movable item itself as disclosed in application Ser. No. 08/801,447.

It is also within the broadest scope of the present invention that the MSR 320 can also form an integral portion of almost any movable item (e.g., bicycle, motorcycle, skateboard, scooter, etc.) by being part of the manufacturing of the movable item itself as disclosed in application Ser. No. 08/801,447. Thus, instead of the visual indicator MSR 320 being readily attachable to almost any movable item, an alternative embodiment of the visual indicator MSR 320 would form an integral portion of the movable item itself. As an example of this alternative embodiment, the visual indicator 324 of FIG. 1 would replace the vibrating indicator 424 of FIG. 6. The supporting electronics (FIGS. 3–4) and their operation would be identical as described previously.

Without further elaboration, the foregoing will so fully illustrate our invention that others may, by applying current or future knowledge, readily adopt the same for use under various conditions of service.

We claim:

1. An motion sensitive reminder apparatus being adaptable for coupling to any item that is movable, said motion sensitive reminder comprising:

a housing;

means for releasably coupling said housing to the movable item;

said housing comprising:

a visual indicator for emitting a visible indication;

a motion sensor for detecting movement of the movable item;

electronic control means, electrically coupled to said visual indicator and to said motion sensor, for controlling said visual indicator emission, said electronic control means activating said visual indicator to emit said visible indication for a predetermined period of time whenever the movable item is initially moved and thereafter deactivating said visual indicator during further motion of the movable item and resetting said visual indicator to prepare to emit said visible indication again whenever the movable item has remained stationary for a certain amount of time.

2. The apparatus of claim 1 wherein said electronic control means resides on a single die.

3. The apparatus of claim 2 wherein said electronic control means comprises a logic and timing circuit for driving said visual indicator, said motion sensor being coupled to said logic and timing circuit through a motion switching circuit that is coupled to said motion sensor.

4. The apparatus of claim 3 wherein said logic and timing circuit comprises a timer for terminating said visible indication after said predetermined period of time.

5. The apparatus of claim 3 wherein said electronic control means further comprises a reset means, coupled between said motion switching circuit and said logic and timing circuit, for resetting the electronic control means whenever said apparatus remains stationary for said certain amount of time.

6. The apparatus of claim 5 wherein said motion switching circuit generates an alternating wave whenever said apparatus is in motion.

7. The apparatus of claim 2 wherein said apparatus further comprises batteries and said electronic control means further comprises a low battery voltage detector coupled to the batteries, said low battery voltage detector monitoring the voltage of the batteries and activating a low battery indicator whenever the voltage falls to a predetermined value.

8. The apparatus of claim 7 wherein said low battery voltage detector is coupled to said motion sensor, said motion sensor enabling said low battery voltage detector to activate said low battery indicator when said motion sensor is detecting motion.

9. The apparatus of claim 8 wherein said low battery voltage detector causes said low battery indicator to flash to conserve power during a low battery voltage condition.

10. The apparatus of claim 1 wherein said electronic control means comprises a logic and timing circuit for driving said visual indicator, said motion sensor being coupled to said logic and timing circuit through a motion switching circuit that is coupled to said motion sensor.

11. The apparatus of claim 10 wherein said logic and timing circuit comprises a timer for terminating said visible indication after said predetermined period of time.

12. The apparatus of claim 10 wherein said electronic control means further comprises a reset means, coupled between said motion switching circuit and said audio circuit, for resetting the electronic control means whenever said apparatus remains stationary for said certain amount of time.

13. The apparatus of claim 12 wherein said motion switching circuit generates an alternating wave whenever said apparatus is in motion.

14. The apparatus of claim 13 wherein said reset means comprises a resistor-capacitor-diode network, said resistor and diode being connected in parallel with said capacitor coupled in series with said parallel connected resistor and diode, said diode and capacitor forming a quick discharge path for discharging said capacitor whenever said apparatus is in motion, and said resistor causing said capacitor to charge for said certain amount of time whenever said apparatus is stationary for said certain amount of time, thereby resetting said visual indicator to prepare to emit again said visible indication.

15. The apparatus of claim 10 wherein said apparatus further comprises batteries and said electronic control means further comprises a low battery voltage detector coupled to the batteries, said low battery voltage detector monitoring the voltage of the batteries and activating a low battery indicator whenever the voltage falls to a predetermined value.

16. The apparatus of claim 15 wherein said low battery voltage detector is coupled to said motion sensor, said motion sensor enabling said low battery voltage detector to activate said low battery indicator when said motion sensor is detecting motion.

17. The apparatus of claim 16 wherein said low battery voltage detector causes said low battery indicator to flash to conserve power during a low battery voltage condition.

18. The apparatus of claim 1 wherein said predetermined period is approximately 6 seconds.

19. The apparatus of claim 1 wherein said certain amount of time is approximately 1 minute.

20. The apparatus of claim 1 wherein said visual indicator comprises a light emitting diode.

21. The apparatus of claim 1 wherein said means for releasably coupling said housing comprises a pair of vertically-oriented L-shaped sleeves disposed on said housing and a clasp, said L-shaped sleeves being adaptable to receive said clasp, said clasp attachable to the movable item.

22. The apparatus of claim 1 wherein said means for releasably coupling said housing comprises a pair of vertically-oriented L-shaped sleeves disposed on said housing and a bar attachment, said L-shaped sleeves being adaptable to receive a portion of said bar attachment, said bar attachment comprising separable semi-circular portions for coupling to a bar.

23. A motion sensitive reminder apparatus being part of any item that is movable, said motion sensitive reminder comprising:

a housing being formed as an integral portion of the movable item, said housing comprising:

a visual indicator for emitting a visible indication;

a motion sensor for detecting movement of the movable item;

electronic control means, electrically coupled to said visual indicator and to said motion sensor, for controlling said visual indicator emission, said electronic control means activating said visual indicator to emit said visible indication for a predetermined period of time whenever the movable item is initially moved and thereafter deactivating said visual indicator during further motion of the movable item and resetting said visual indicator to prepare to emit said visible indication again whenever the movable item has remained stationary for a certain amount of time.

24. The apparatus of claim 23 wherein said electronic control means resides on a single die.

25. The apparatus of claim 24 wherein said electronic control means comprises a logic and timing circuit for driving said visual indicator, said motion sensor being coupled to said logic and timing circuit through a motion switching circuit that is coupled to said motion sensor.

26. The apparatus of claim 25 wherein said logic and timing circuit comprises a timer for terminating said visible indication after said predetermined period of time.

27. The apparatus of claim 25 wherein said electronic control means further comprises a reset means, coupled between said motion switching circuit and said logic and timing circuit, for resetting the electronic control means whenever said apparatus remains stationary for said certain amount of time.

28. The apparatus of claim 27 wherein said motion switching circuit generates an alternating wave whenever said apparatus is in motion.

29. The apparatus of claim 24 wherein said apparatus further comprises batteries and said electronic control means further comprises a low battery voltage detector coupled to the batteries, said low battery voltage detector monitoring the voltage of the batteries and activating a low battery indicator whenever the voltage falls to a predetermined value.

30. The apparatus of claim 29 wherein said low battery voltage detector is coupled to said motion sensor, said motion sensor enabling said low battery voltage detector to activate said low battery indicator when said motion sensor is detecting motion.

31. The apparatus of claim 30 wherein said low battery voltage detector causes said low battery indicator to flash to conserve power during a low battery voltage condition.

32. The apparatus of claim 23 wherein said electronic control means comprises a logic and timing circuit for driving said visual indicator, said motion sensor being coupled to said logic and timing circuit through a motion switching circuit that is coupled to said motion sensor.

33. The apparatus of claim 32 wherein said logic and timing circuit comprises a timer for terminating said visible indication after said predetermined period of time.

34. The apparatus of claim 32 wherein said electronic control means further comprises a reset means, coupled between said motion switching circuit and said logic and timing circuit, for resetting the electronic control means whenever said apparatus remains stationary for said certain amount of time.

35. The apparatus of claim 34 wherein said motion switching circuit generates an alternating wave whenever said apparatus is in motion.

36. The apparatus of claim 35 wherein said reset means comprises a resistor-capacitor-diode network, said resistor and diode being connected in parallel with said capacitor coupled in series with said parallel connected resistor and diode, said diode and capacitor forming a quick discharge path for discharging said capacitor whenever said apparatus is in motion, and said resistor causing said capacitor to charge for said certain amount of time whenever said apparatus is stationary for said certain amount of time, thereby resetting said visual indicator to prepare to emit again said visible indication.

37. The apparatus of claim 32 wherein said apparatus further comprises batteries and said electronic control means further comprises a low battery voltage detector coupled to the batteries, said low battery voltage detector monitoring the voltage of the batteries and activating a low battery indicator whenever the voltage falls to a predetermined value.

38. The apparatus of claim 37 wherein said low battery voltage detector is coupled to said motion sensor, said motion sensor enabling said low battery voltage detector to activate said low battery indicator when said motion sensor is detecting motion.

39. The apparatus of claim 38 wherein said low battery voltage detector causes said low battery indicator to flash to conserve power during a low battery voltage condition.

40. The apparatus of claim 23 wherein said predetermined period is approximately 6 seconds.

41. The apparatus of claim 23 wherein said certain amount of time is approximately 1 minute.

42. The apparatus of claim 23 wherein said visual indicator comprises a light emitting diode.

43. A motion sensitive reminder apparatus being part of any item that is movable and that is worn by the user, said motion sensitive reminder comprising:

a housing being formed as an integral portion of the movable item, said housing comprising:

a tactile indicator for emitting a tactile indication;

a motion sensor for detecting movement of the movable item;

electronic control means, electrically coupled to said tactile indicator and to said motion sensor, for controlling said tactile indicator emission, said electronic control means activating said tactile indicator to emit said tactile indication for a predetermined period of time whenever the movable item is initially moved and thereafter deactivating said tactile indicator during further motion of the movable item and resetting said tactile indicator to prepare to emit said tactile indication again whenever the movable item has remained stationary for a certain amount of time.

44. The apparatus of claim 43 wherein said electronic control means resides on a single die.

45. The apparatus of claim 44 wherein said electronic control means comprises a logic and timing circuit for driving said tactile indicator, said motion sensor being coupled to said logic and timing circuit through a motion switching circuit that is coupled to said motion sensor.

46. The apparatus of claim 45 wherein said logic and timing circuit comprises a timer for terminating said tactile indication after said predetermined period of time.

47. The apparatus of claim 45 wherein said electronic control means further comprises a reset means, coupled between said motion switching circuit and said logic and timing circuit, for resetting the electronic control means whenever said apparatus remains stationary for said certain amount of time.

48. The apparatus of claim 47 wherein said motion switching circuit generates an alternating wave whenever said apparatus is in motion.

49. The apparatus of claim 44 wherein said apparatus further comprises batteries and said electronic control means further comprises a low battery voltage detector coupled to the batteries, said low battery voltage detector monitoring the voltage of the batteries and activating a low battery indicator whenever the voltage falls to a predetermined value.

50. The apparatus of claim 49 wherein said low battery voltage detector is coupled to said motion sensor, said motion sensor enabling said low battery voltage detector to activate said low battery indicator when said motion sensor is detecting motion.

51. The apparatus of claim 50 wherein said low battery voltage detector causes said low battery indicator to flash to conserve power during a low battery voltage condition.

52. The apparatus of claim 43 wherein said electronic control means comprises a logic and timing circuit for driving said tactile indicator, said motion sensor being coupled to said logic and timing circuit through a motion switching circuit that is coupled to said motion sensor.

53. The apparatus of claim 52 wherein said logic and timing circuit comprises a timer for terminating said tactile indication after said predetermined period of time.

54. The apparatus of claim 53 wherein said predetermined period is approximately 6 seconds.

55. The apparatus of claim 53 wherein said certain amount of time is approximately 1 minute.

56. The apparatus of claim 52 wherein said electronic control means further comprises a reset means, coupled between said motion switching circuit and said logic and timing circuit, for resetting the electronic control means whenever said apparatus remains stationary for said certain amount of time.

57. The apparatus of claim 56 wherein said motion switching circuit generates an alternating wave whenever said apparatus is in motion.

58. The apparatus of claim 57 wherein said reset means comprises a resistor-capacitor-diode network, said resistor and diode being connected in parallel with said capacitor coupled in series with said parallel connected resistor and diode, said diode and capacitor forming a quick discharge path for discharging said capacitor whenever said apparatus is in motion, and said resistor causing said capacitor to charge for said certain amount of time whenever said apparatus is stationary for said certain amount of time, thereby resetting said tactile indicator to prepare to emit again said tactile indication.

59. The apparatus of claim 52 wherein said apparatus further comprises batteries and said electronic control means further comprises a low battery voltage detector coupled to the batteries, said low battery voltage detector monitoring the voltage of the batteries and activating a low battery indicator whenever the voltage falls to a predetermined value.

60. The apparatus of claim 59 wherein said low battery voltage detector is coupled to said motion sensor, said motion sensor enabling said low battery voltage detector to activate said low battery indicator when said motion sensor is detecting motion.

61. The apparatus of claim 60 wherein said low battery voltage detector causes said low battery indicator to flash to conserve power during a low battery voltage condition.

* * * * *